US006742320B1

(12) United States Patent
Rapparini

(10) Patent No.: US 6,742,320 B1
(45) Date of Patent: Jun. 1, 2004

(54) AUTOMATIC PACKAGING MACHINE FOR SEALING BAGS UNDER CONDITIONED ATMOSPHERE

(76) Inventor: Ulisse Rapparini, Via Niccolini, 5, I-44100 Ferrara (IT)

( * ) Notice: Subject to any disclaimer, the term of this patent is extended or adjusted under 35 U.S.C. 154(b) by 48 days.

(21) Appl. No.: 10/110,214

(22) PCT Filed: Oct. 16, 2000

(86) PCT No.: PCT/IB00/01478

§ 371 (c)(1),
(2), (4) Date: Apr. 19, 2002

(87) PCT Pub. No.: WO01/28859

PCT Pub. Date: Apr. 26, 2001

(30) Foreign Application Priority Data

Oct. 20, 1999 (IT) ..... BO99A0564

(51) Int. Cl.[7] ..... B65B 31/00

(52) U.S. Cl. ..... 53/510; 53/403; 53/405; 53/79; 53/86; 53/88; 53/91; 53/94; 53/95; 53/97

(58) Field of Search ..... 53/403, 405, 79, 53/86, 88, 91, 94, 95, 97, 510

(56) References Cited

U.S. PATENT DOCUMENTS

| | | | | | |
|---|---|---|---|---|---|
| 3,393,491 | A | * | 7/1968 | Burton | 53/101 |
| 4,312,171 | A | * | 1/1982 | Vadas | 53/403 |
| 4,439,976 | A | * | 4/1984 | Yuji et al. | 53/403 |
| 4,798,039 | A | * | 1/1989 | Deglise | 53/432 |
| 4,845,927 | A | * | 7/1989 | Rapparini | 53/511 |
| 5,144,788 | A | * | 9/1992 | Varlet | 53/434 |
| 5,237,797 | A | * | 8/1993 | Varlet | 53/420 |
| 5,887,409 | A | * | 3/1999 | Leal Pereira Da Silva | 53/434 |
| 6,141,940 | A | * | 11/2000 | Bombe | 53/432 |
| 6,182,421 | B1 | * | 2/2001 | Sullivan | 53/438 |

FOREIGN PATENT DOCUMENTS

| | | |
|---|---|---|
| DE | 44 31 458 | 3/1996 |
| FR | 1 281 240 | 5/1962 |
| WO | 97 30896 | 8/1997 |

* cited by examiner

*Primary Examiner*—Eugene Kim
*Assistant Examiner*—Christopher Harmon
(74) *Attorney, Agent, or Firm*—Oblon, Spivak, McClelland, Maier & Neustadt, P.C.

(57) ABSTRACT

An automatic packing machine for conditioning bags under conditioned atmosphere, in which the sealing operation of the bags occurs inside a pneumatically insulated space that is composed by a conditioning chamber which contains the already conditioned bag, and by a sealing chamber which contains the sealing equipment, after that the chambers have been put in communication through the opening of the lid of the conditioning chamber.

5 Claims, 7 Drawing Sheets

AUTOMATIC PACKAGING MACHINE FOR SEALING BAGS UNDER CONDITIONED ATMOSPHERE

TECHNICAL FIELD

The present invention refers to the technical field of automatic packaging machines construction, specifically for the conditioning of bags under controlled atmosphere. International Classification B65 b.

STATE OF THE PRIOR ART

In the prior art are known several kinds of machines that seal bags under vacuum or under controlled atmosphere. In the known packaging machines each conditioning chamber is provided with its own sealing equipment.

Such machines are usually cumbersome and heavy, and also very expensive because of the high number of components that are not active during large part of the production process, and that intervene only during the packets' sealing phase.

In the prior art there is EP 0929445 that shows a machine including a plurality of conditioning chambers and only one sealing chamber. It is clear that said solution presents considerable problems of wear of the sliding gaskets of the single fixed lid that closes all the conditioning chambers.

The present invention solves the problem of the slide wear of such gasket parts of the lid of the conditioning chamber.

DESCRIPTION

The present invention is now described with reference to the figures of the attached drawings as not limiting example.

FIG. 1 represents a perspective scheme of an automatic packaging machine for conditioning bags under controlled atmosphere. One can observe the presence of a plurality of conditioning chambers (1) distributed along a clockwise circular path. Also, the presence of only one sealing chamber (3), inside which a single sealing equipment, (4) is set up, can be noted. In this figure is clear the presence of closing lids (5) that make the chambers (1) hermetic.

It should be pointed out that FIG. 1 represents a stationing phase during which an already conditioned and sealed bag is removed from its conditioning chamber (1) while another bag, still be to conditioned, is introduced in the next chamber. It is clear that during the introduction and removal operations of the bags, the lid (5) is fully open. Said lid (5) is hermetically closed in all the other chambers where the whole conditioning process occurs.

FIG. 2 represents in detail the phase when a chamber (1), with the lid hermetically closed to allow the completing of the conditioning through the conduit (6), rests by the sealing chamber (3). This chamber is lifted up, that is not yet in hermetic contact with the chamber underneath (1).

It is clear that during this phase the conditioning of the chamber (3) through the conduit (7) can't be activated.

FIG. 3 represents the sealing of the bag.

It can be noted that the sealing chamber (3) has been brought in hermetic contact with the chamber (1), that has already been conditioned in order to activate, through the conduit (7), also the conditioning of said chamber (3).

Afterwards, the opening of the lid (5) will allow the intervention of the sealing equipment (4) to perform the sealing of the bag within the hermetic environment consisting of the chamber (1) and the chamber (3).

In this figure one can note that the sealing operation happens simultaneously inside of two insulated spaces formed by two conditioning chambers and two sealing chambers.

Obviously the two linked sealing chambers, after having followed the moving of the two corresponding conditioning chambers, go back to the initial position as indicated by the arrow (8).

Figure 1:
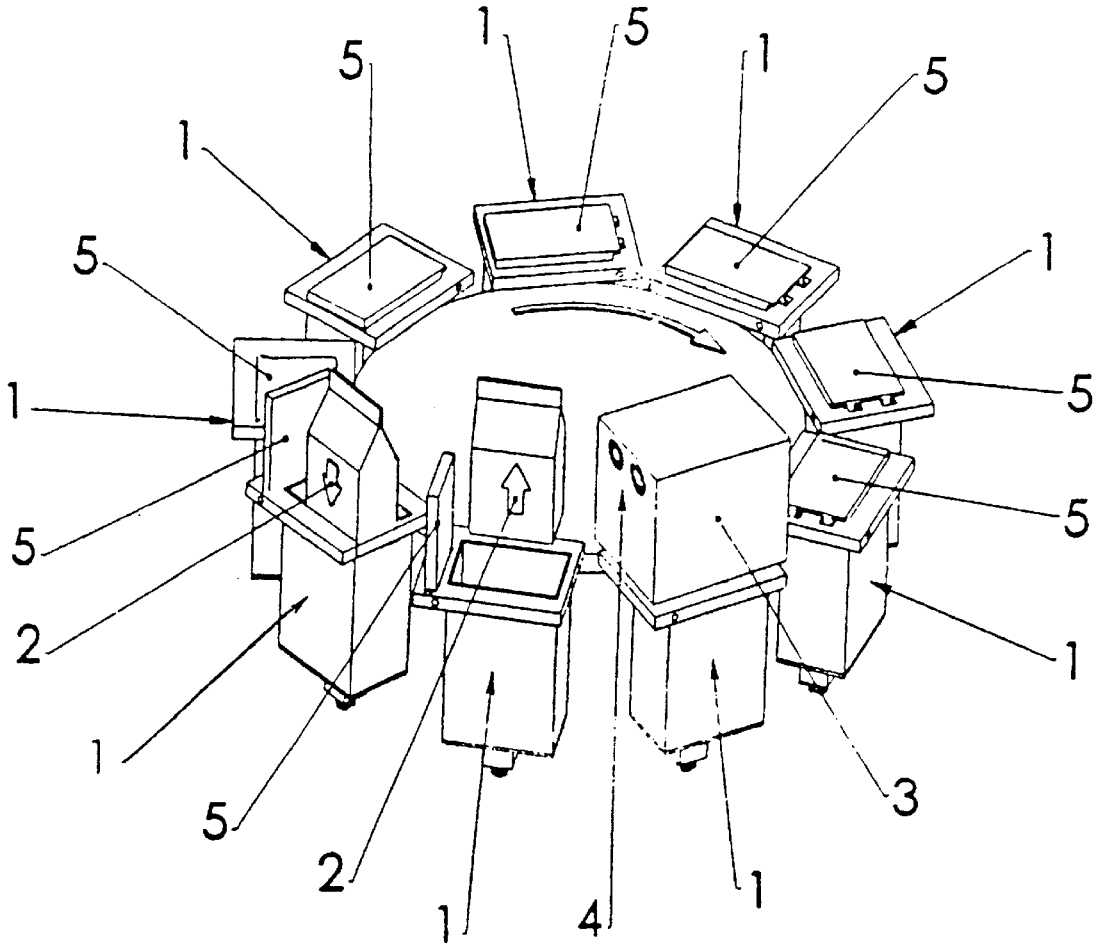
Figure 2:
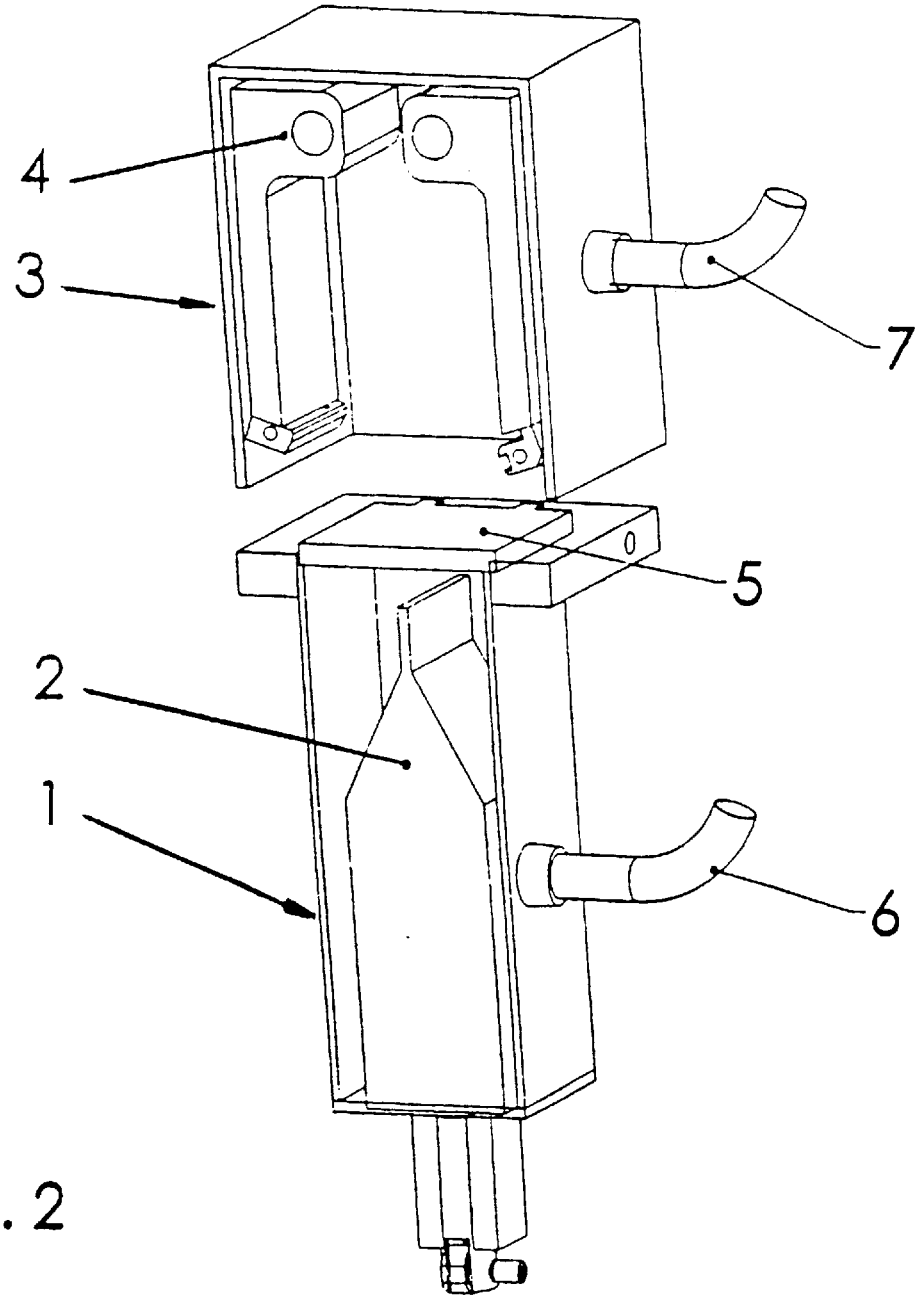
Figure 3:
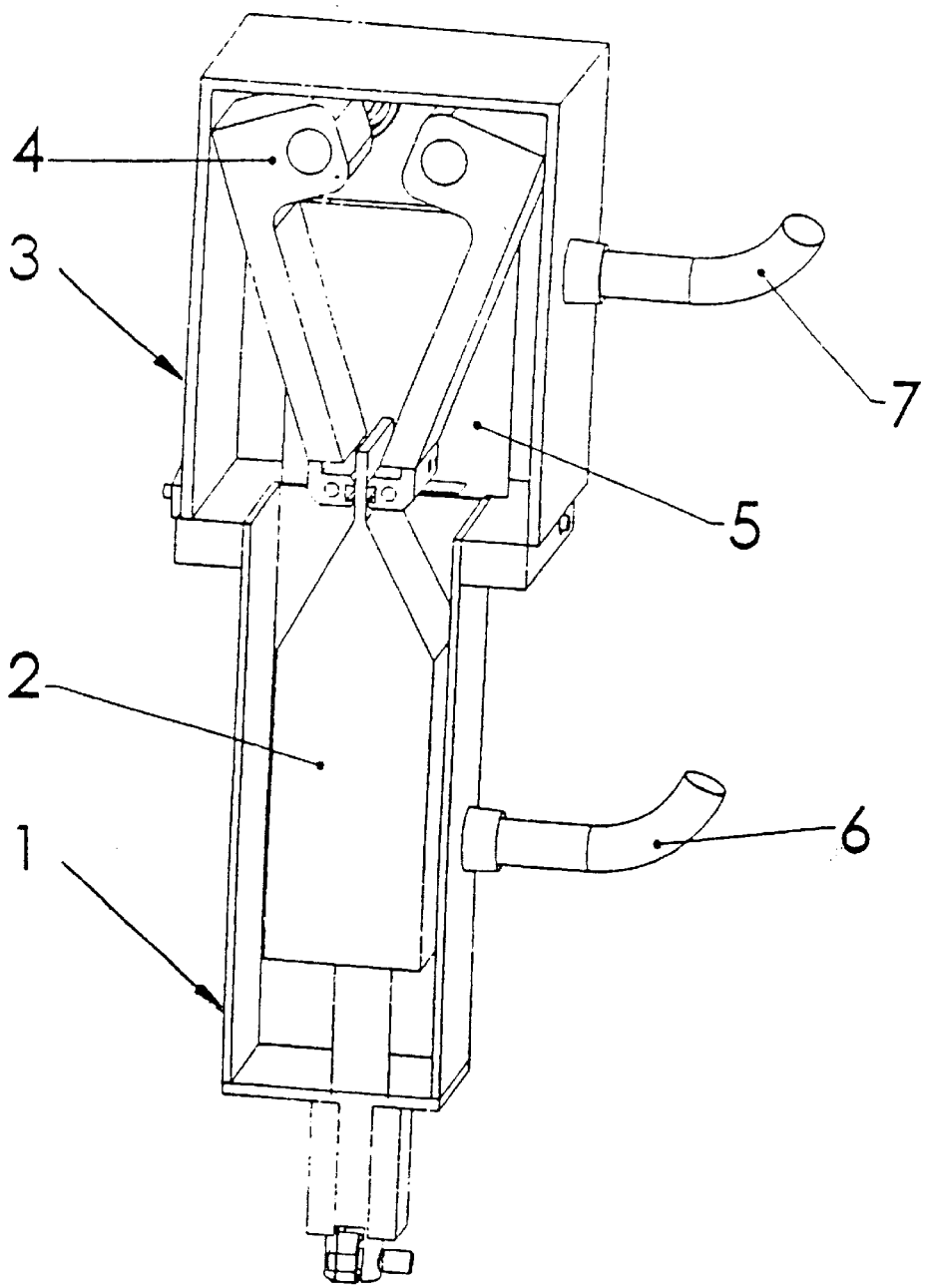
Figure 4:
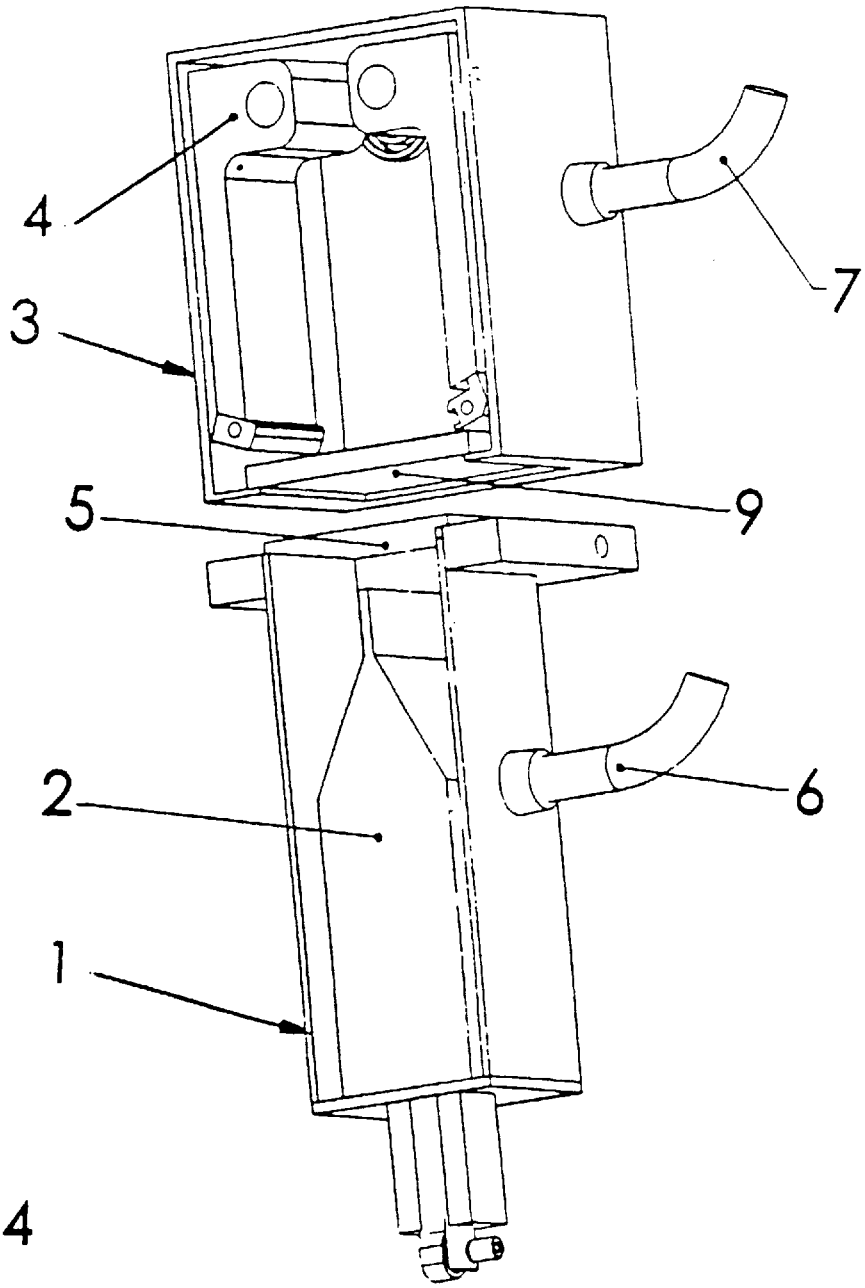
FIG. 4 represents a perspective scheme of another version of the sealing chamber (3). In this respect, it can be noted the presence of another lid (9) that closes hermetically said chamber to allow the conditioning through the pertinent conduit (7) even before that the two chambers (1,3) are being in touch with each other.
Figure 5:
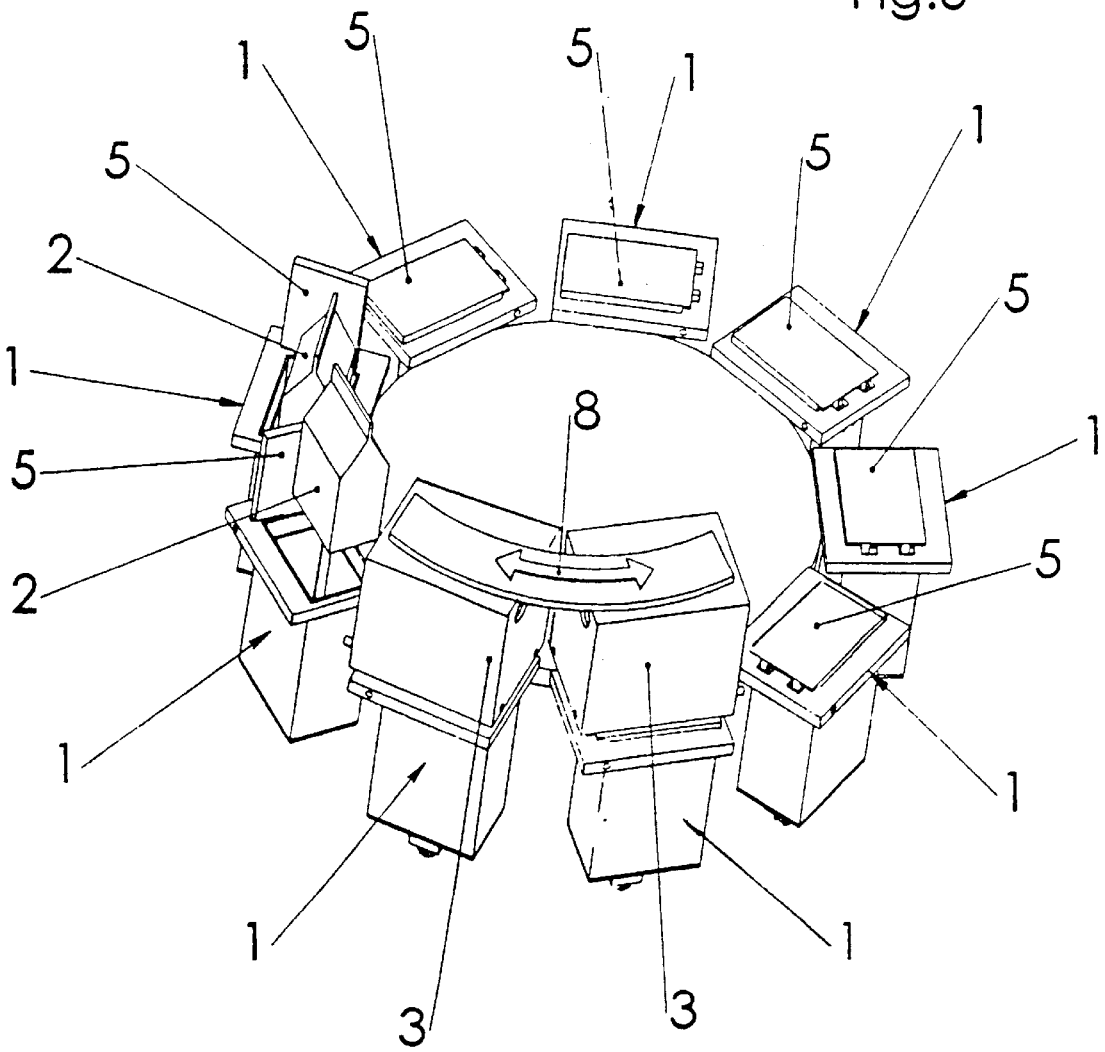
FIG. 5 represents another version in which to increase the productivity two sealing chambers (3) are put together and are moved in order to follow the motion of the corresponding conditioning chambers.
Figure 6:
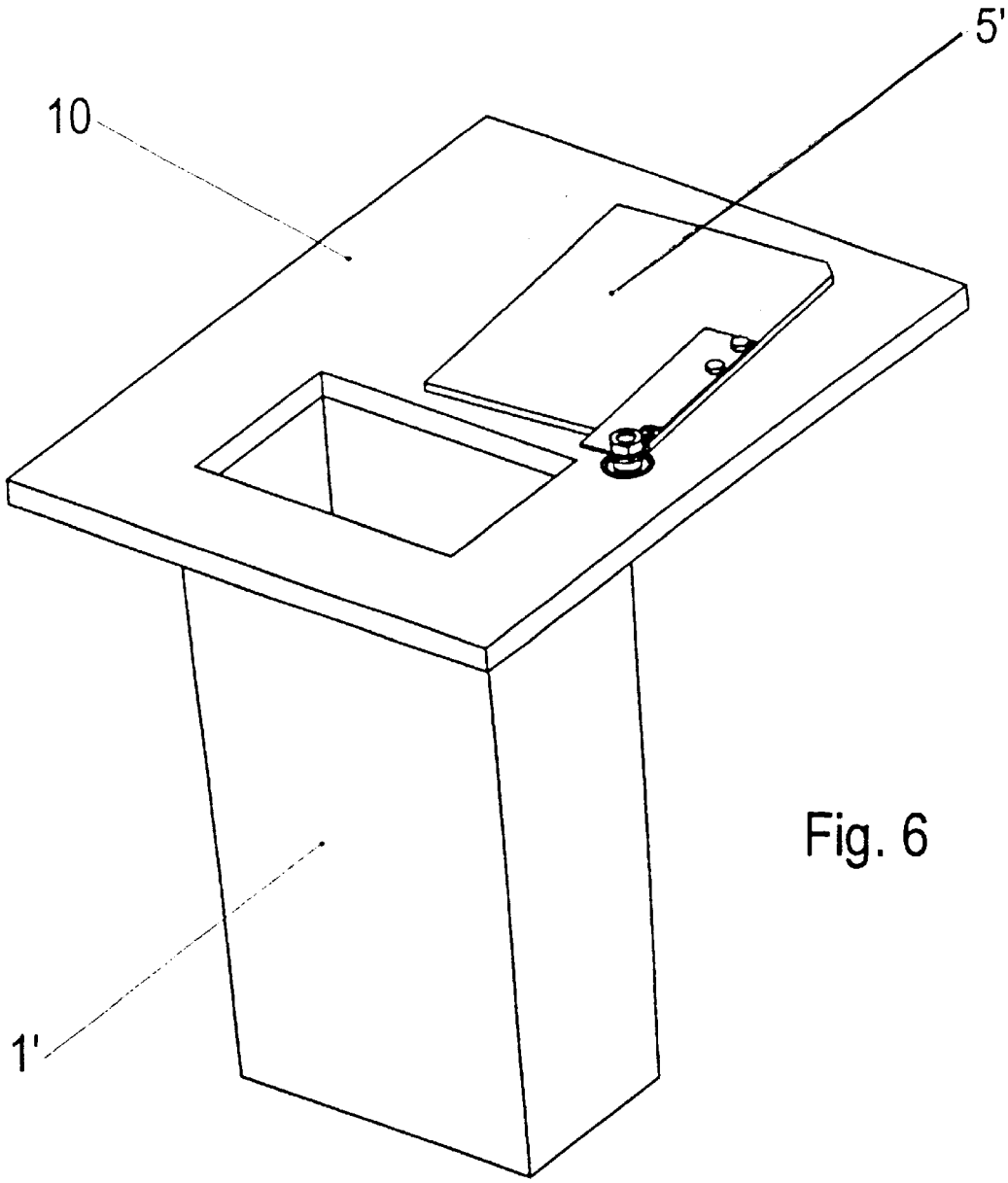

FIG. 6 shows a variation to the opening system of the conditioning chamber's (1') lids. In this figure is sketched a lid (5') that opens and closes while sliding.

Such variation allows for a smaller size of the sealing equipment and of the sealing chamber (3'), and also accounts for a considerable reduction of the space to be conditioned through the pertinent conduit (7').

In the same FIG. 6 one can easily observe that the conditioning chamber (1') is provided with a broad upper surface (10) that is able to contain the sliding closing lid (5') up to its maximum opening range.

Figure 7:
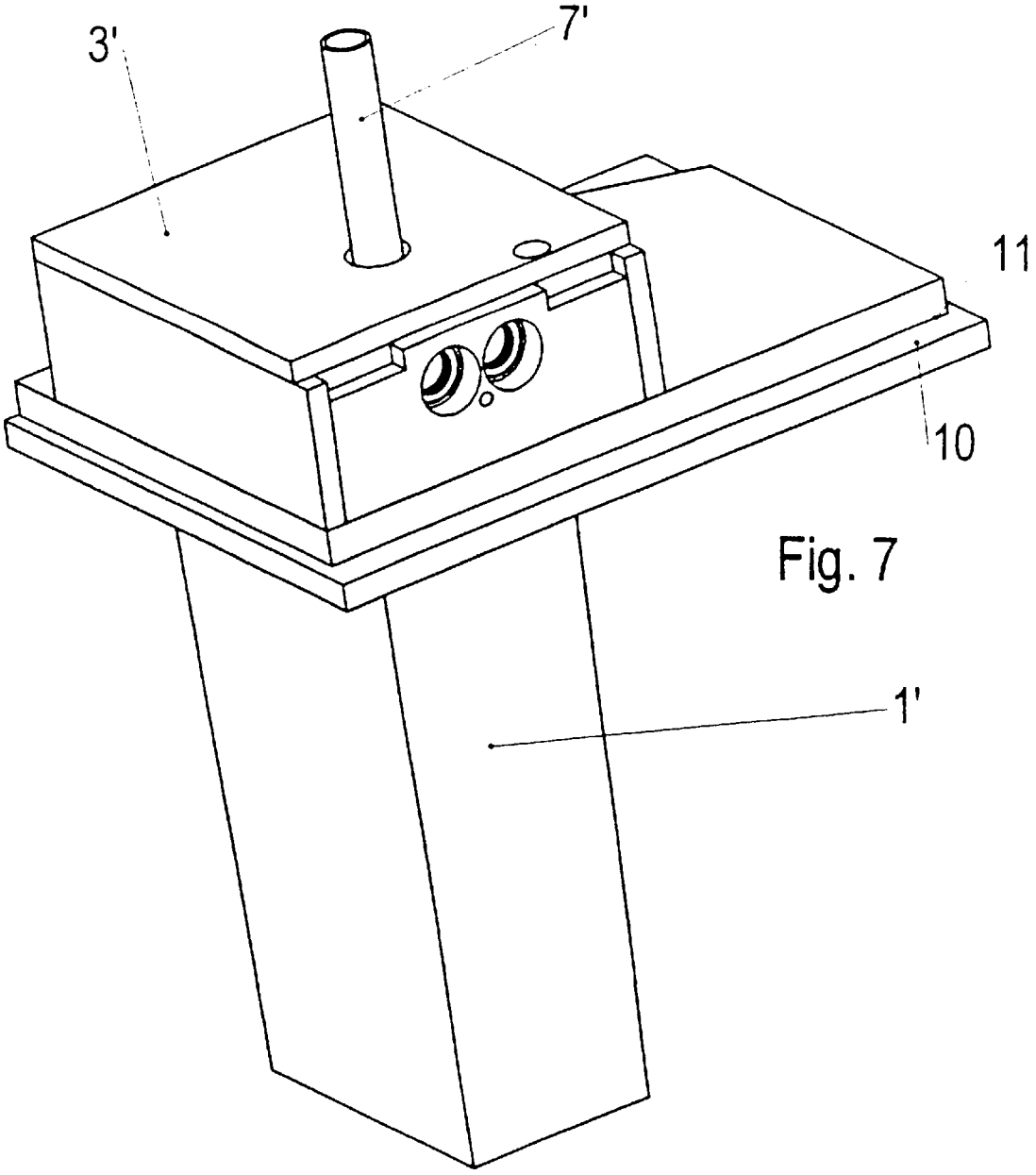

FIG. 7 shows the same variation on the sealing chamber (3'). In this figure a broad lower surface (11), that matches with the surface (10), can be observed.

In all the figures each single detail is marked as follows:

1 indicates a conditioning chamber
1' indicates a conditioning chamber provided with a broad upper surface.
2 is a bag
3 indicates a sealing chamber
4 is the sealing equipment
5 is the lid for closing the chamber (1)
5' is the lid with sliding opening
6 is the conduit for conditioning the chamber (1)
7 is the conduit for conditioning the chamber (3)
7' is the conduit for conditioning the chamber (3')
8 is the system to move the two linked sealing chambers
9 is the lid to close the chambers (3)
10 indicates the broad upper surface of the conditioning chamber (1')
11 indicates the broad lower surface of the sealing chamber (3')

The clarity of the figures points out the functional and structural simplicity of the machine as illustrated so far. Indeed, it can be noted that the conditioning chambers are very simple and that the coming of the bags to be conditioned is made easier by the lack of sealing equipment.

The opening systems of the lids of the conditioning chambers and of the sealing chamber can be realized with different geometric configurations and different possibilities of realization.

The invention can of course be improved or modified with several options of practical realization as far as the structural proportioning of the different parts and the technological choices of the construction materials are concerned.

It is clear that the number and the geometric location of conditioning chambers can be adjusted according to the production needs of the technological process and the different formats of the bags to be conditioned.

All the automatic packaging machines for conditioning bags under vacuum or under controlled atmosphere in which the sealing operation of the bags occurs inside an hermetic space formed by a conditioning chamber put in communication with a sealing chamber through the opening of a pertinent lid and showing the characteristics basically similar to the ones described, showed and hereinafter claims, will be considered as part of the protection domain of the present invention.

What is claimed is:

1. An automatic packing machine for conditioning bags under a conditioned atmosphere, comprising:

at least one conditioning chamber for containing and conditioning a bag, said conditioning chamber comprising a lid adapted to hermetically close the conditioning chamber; and at least one sealing chamber containing sealing equipment for sealing the bag, said sealing chamber being adapted to be brought in hermetic contact with said conditioning chamber, wherein said conditioning chamber and said sealing chamber are adapted to be put in communication with each other by opening the lid and thereby forming a pneumatically insulated space containing the bag, and wherein the sealing equipment is adapted to perform a sealing operation of the bag inside of the pneumatically insulated space.

2. The automatic packing machine of claim 1, wherein the sealing chamber is equipped with a second lid adapted to insulate the sealing chamber hermetically from the outside.

3. The automatic packing machine of claim 1, wherein the conditioning chamber is adapted to move and the sealing chamber is adapted to follow a motion of the conditioning chamber while the sealing operation is performed.

4. The automatic packing machine of claim 1, wherein the lid of the conditioning chamber is adapted to open and close in a sliding manner thereby remaining below the sealing equipment.

5. The automatic packing machine of claim 4, wherein the lid comprises a closed position and a wide opened position, and wherein the conditioning chamber is provided with a broad upper surface and the sealing chamber is provided with a broad lower surface, with both surfaces being large enough to encase the lid during its sliding movement between said maximum opened and closed positions.

* * * * *